United States Patent [19]

Jones et al.

[11] 4,170,301

[45] Oct. 9, 1979

[54] POTTED PLANT SHIPPER

[75] Inventors: Ancil A. Jones, Mooresville; Dwight C. Schmidt, Carmel, both of Ind.

[73] Assignee: Inland Container Corporation, Indianapolis, Ind.

[21] Appl. No.: 843,731

[22] Filed: Oct. 19, 1977

[51] Int. Cl.[2] ..... B65D 85/52

[52] U.S. Cl. ..... 206/423; 47/84; 206/45.19; 206/521; 229/15

[58] Field of Search ..... 47/84; 206/45.14, 45.19, 206/423, 434, 521, 526; 220/408, 410; 229/15, 42, 35

[56] References Cited

U.S. PATENT DOCUMENTS

| | | | |
|---|---|---|---|
| 2,578,878 | 12/1951 | Buttery | 229/35 |
| 3,028,005 | 4/1962 | Shaffer | 206/423 |
| 3,284,949 | 11/1966 | Park | 47/84 |
| 3,342,401 | 9/1967 | Kitchell | 229/35 |
| 3,606,004 | 9/1971 | Fruehwirth | 206/423 |
| 3,682,369 | 8/1972 | Isakson | 229/35 |

FOREIGN PATENT DOCUMENTS

| | | | |
|---|---|---|---|
| 1413806 | 8/1965 | France | 206/423 |
| 2303735 | 10/1976 | France | 206/423 |

*Primary Examiner*—Stephen Marcus

*Attorney, Agent, or Firm*—Fitch, Even & Tabin

[57] ABSTRACT

A potted plant shipper which incorporates elongated plant holders within an outer fiberboard container. Each of the holders is formed from an integral blank which is foldable into three walls, plus a pair of partial cover panels. Locking flaps close the respective ends and secure the elongated holders in tubular form. The outer container locates the elongated holders in side-by-side relationship on its bottom panel with the foliage extending upward into an open region. The end flaps of the containers cooperate to provide a pair of inward-extending hold-down flanges which overlie the ends of the holders to prevent upward displacement during shipping. The end flaps interlock with one another to secure the closure.

10 Claims, 7 Drawing Figures

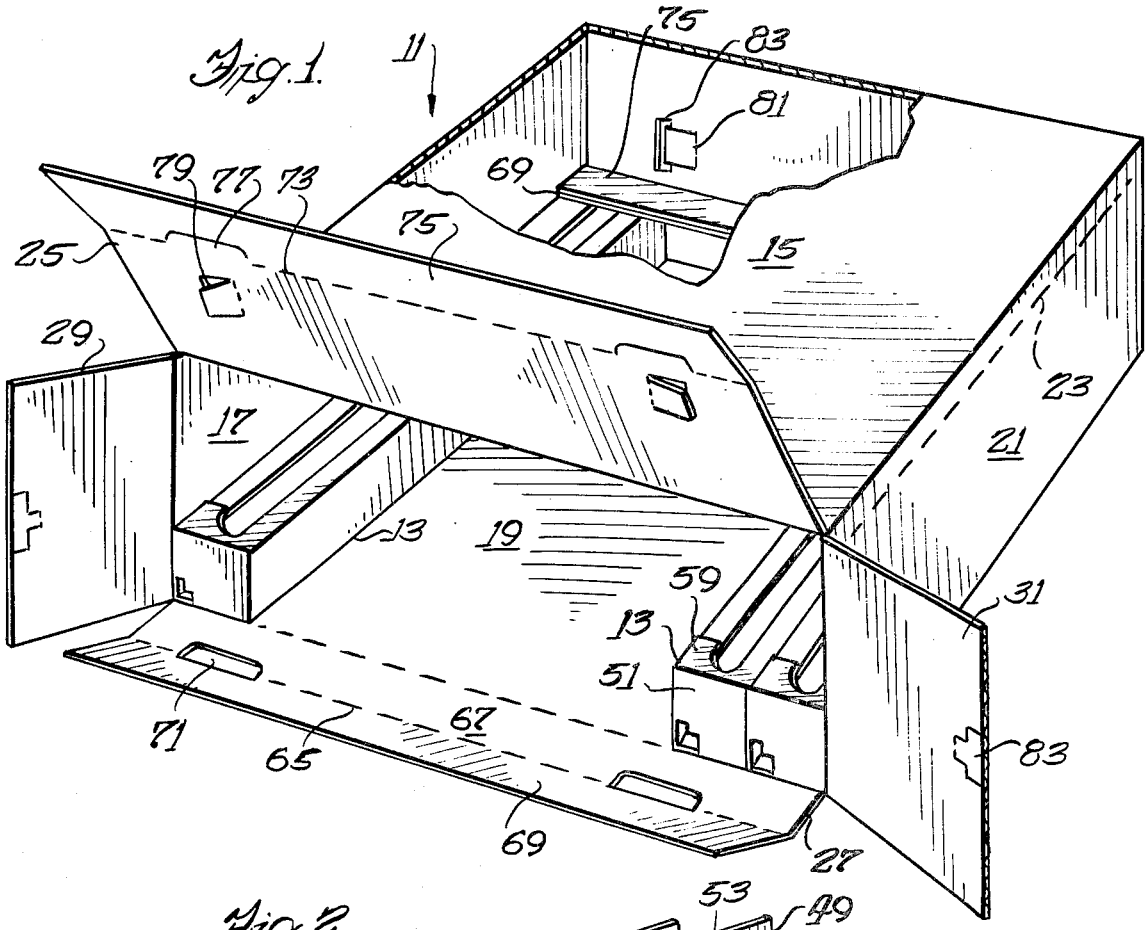
Fig. 1.
11
75
83
81
69
79
77
73
75
15
25
29
17
23
21
13
19
59
13
31
51
71
65
67
83
69
27
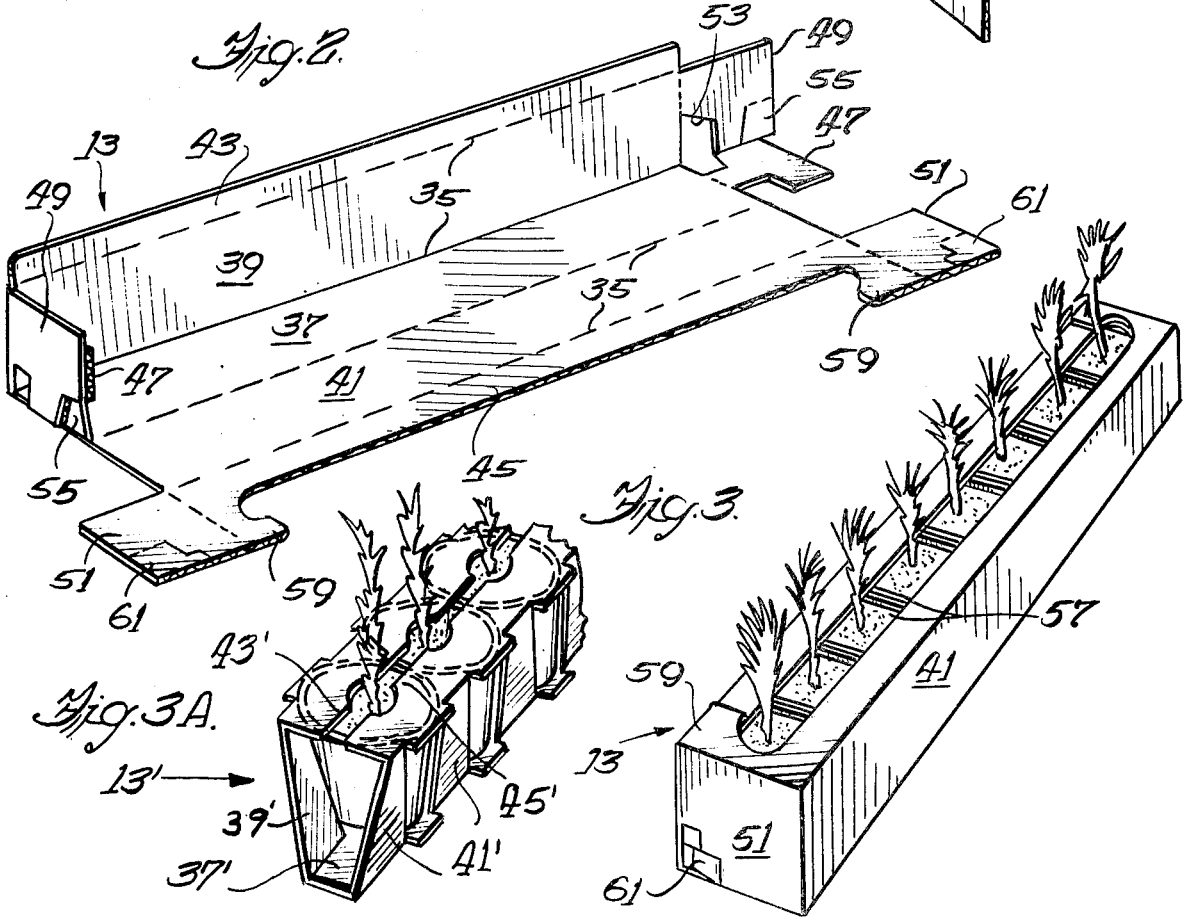
Fig. 2.
53
49
55
47
13
43
51
61
49
35
39
35
37
59
47
41
45
55
51
61
59
Fig. 3.
57
41
59
13
51
61
Fig. 3A.
43'
13'
39'
45'
41'
37'

POTTED PLANT SHIPPER

This invention relates to the shipment of potted plants and more particularly to a fiberboard package for securely packing a number of rows of potted plants for shipment from one location to another.

One example of a fiberboard shipping container for the shipment of potted growing plants is shown in U.S. Pat. No. 3,606,004, issued Sept. 20, 1971 to Fruehwirth. In this construction, potted plants are collected within longitudinally extending trays, and the trays are located in parallel, spaced apart positions in a double-layer arrangement, being held in position by means of locators that are incorporated as a part of a die-cut pad. The foregoing pad assembly is secured in the lower portion of an outer container by a folded side flap of the container. Simpler and more efficient packages for shipping potted plants are desired.

The present invention provides an outer container formed from a one-piece blank which efficiently and effectively secures a plurality of potted plant holders in side-by-side relationship to totally cover the container bottom. Each of the individual holders incorporates its own locking means which permits it to be assembled as a sleeve about a row of potted plants and then both ends to be locked to assure the integrity of the individual assembly. Locking features of the individual holders and of the outer case are both self-contained so that there is no gluing, stapling or taping necessary to complete the package.

Additional objects of the invention will be apparent from the following detailed description of a preferred embodiment of a potted-plant shipping package when read in conjunction with the accompanying drawings wherein:

FIG. 1 is a perspective view of a potted-plant shipping package having portions broken away, with one end shown open and with the potted plants omitted from the individual holders for the sake of clarity;

FIG. 2 is a partially assembled perspective view of one of the blanks from which the potted-plant holders are formed;

FIG. 3 is a perspective view of a fully assembled holder shown with a row of plants in square pots installed therein, in the form in which it would be inserted into the outer container;

FIG. 3A is a perspective view similar to FIG. 3 of an alternative embodiment of a holder containing plants in round pots;

Figure 4:
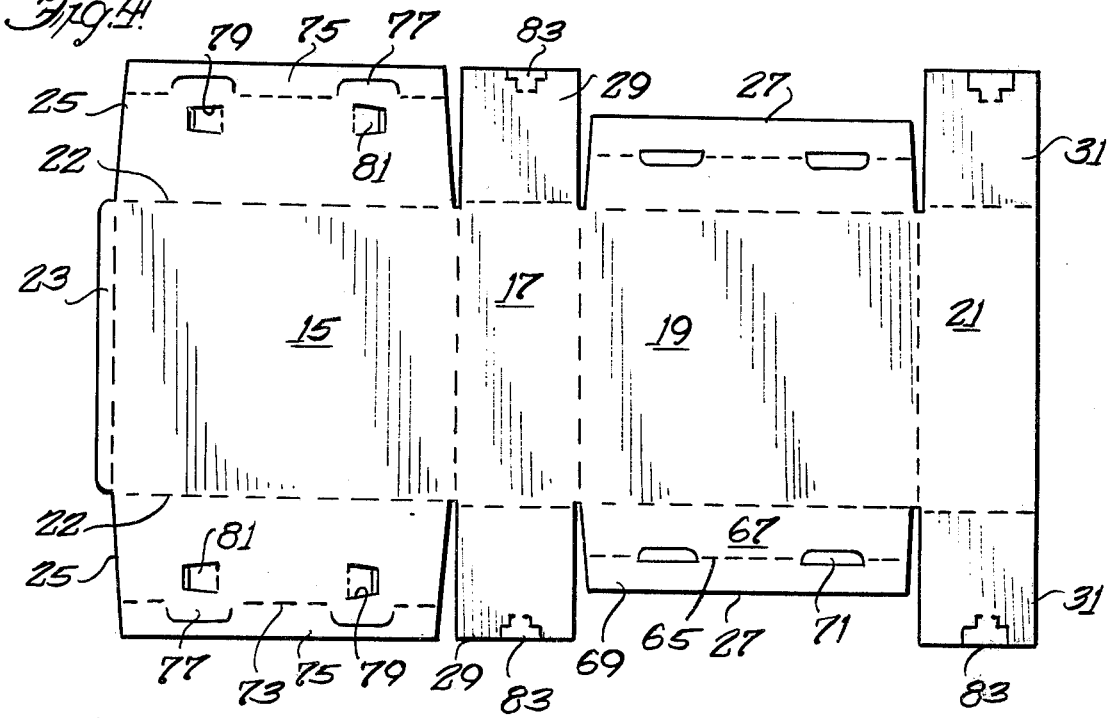
FIG. 4 is a layout view of the fiberboard blank from which the outer container is formed.

FIG. 1 shows an outer container 11 in its set-up condition with three plant holders 13 installed therein. Of course, the holders 13 would not be installed in the outer container 11 until each was filled with a row of potted plants, as depicted in FIG. 3; however, for ease of illustration, the potted plants are omitted from FIG. 1. The outer container 11 includes a top panel 15, a left-hand side panel 17, a bottom panel 19 and a right side panel 21 which are serially joined together to form a tubular enclosure of rectangular cross-section. Each of the ends of the enclosure are closed by four flaps respectively hinged to each of the just-mentioned panels.

As depicted in FIG. 4, the outer container 11 is formed from a single blank which is die-cut from a generally rectangular sheet of corrugated fiberboard, in which the flutes preferably run parallel to the four parallel score lines which, along with two transverse score lines 22, define the top panel 15, the bottom panel 19, the two side panels 17 and 21 plus a glue flap 23, which is hinged to the free lateral edge of the top panel 15. In forming the manufacturer's joint, the glue flap 23 is preferably adhesively connected to the interior surface of the side wall 21, as depicted in FIG. 1.

The end closures of the outer container 11 are self-locking and are each formed by four separate flaps which are each hinged, along the two generally common score lines 22, to an end of one of the four body panels. More specifically, as shown in FIG. 4, the end closures are made up of a top flap 25 and a bottom flap 27, hinged respectively to the top and bottom panels 15,19, and a pair of side flaps 29,31 hinged respectively to the side panels 17,21. The specific construction and the locking interengagement of the end closure flaps is described hereinafter in respect of the closing of the loaded container.

The blank from which the holders 13 are formed is illustrated in partially assembled condition in FIG. 2. The blank includes four longitudinally extending lines of weakness 35 which define a bottom 37, a pair of side walls 39,41, and partial cover panels 43,45 hinged to the upper edges of the two side walls. A generally T-shaped flap 47 is hinged to each end of the bottom 37 and a generally square flap 49 is hinged to the side wall 39 to which the smaller panel 43 of the two partial cover panels is hinged. Square flaps 51 are also hinged to each end of the larger partial cover panel 45.

An access aperture 53 is die-cut from the inner corner of each of the flaps 49, and a generally trapezoidal tab 55 is also formed at the lower outer corner of these flaps. In setting up the holder 13, the side wall 39 is first bent at 90° to the bottom 37, and the T-shaped flaps 47 are bent upward at a right angle to the bottom. After the flaps 49 are bent inward into contact with the outer surface of the flaps 47, each trapezoidal tab 55 is pushed inward to engage the base of the T and thus latch the two flaps together, as shown at the left-hand end of FIG. 2. After the flaps 47 and 49 at both ends are latched together, a row of potted plants 57 can be set onto the bottom 37 to fill the holder. The plants may have either square or round pots, but the holders 13 are proportioned accordingly to better accept pots of a square configuration.

Thereafter, the smaller partial cover 43 is bent downward over the top of the pots 57, and the remaining side wall 41 and the larger cover panel 45 are folded upward. When the larger cover panel 45 is bent downward into overlying relationship with the edges of the pots, its end portions 59 will overlie the ends of the smaller cover panel 43 and thus completely entrap the potted plants 57 within the holder 13. The end flaps 51 that are hinged to the cover panels 45 are then bent downward to form the exterior end walls of the holder, and locking is completed by pressing L-shaped tabs 61 inward through the access apertures 53 and past the T-shaped flaps 47 so that the upper portion of the tab locks against the interior surface of the flap 47, as depicted in FIG. 3. The completed holder 13 is a stable, integral unit which can be moved by a conveyor or the like to a final loading location.

FIG. 3A illustrates a corrugated fiberboard holder 13' designed for plants in round pots which is formed from a die-cut blank containing spaced openings through which the edges of the pots protrude. Side walls are provided by the spaced-apart strips 39',41' that are hinged at their upper ends to the partial cover panels 43',45' and at their lower ends to the bottom 37'. The length of the side walls 41' is such that a friction-fit is created at the top and bottom of each pot so that the locking flaps are not needed at the ends to create a stable, integral unit.

Once the requisite number of holders 13 are filled with potted plants 57, they are ready to be packed or loaded into an outer container 11. The outer container 11 depicted in FIG. 1 is designed to accommodate eight holders 13 although for the sake of simplicity only three are shown. One end of the outer container 11 may be first closed and then the loading effected, or all eight of the holders 13 can be first loaded in the enclosure and then both ends of the container closed. When one end of the container is initially closed, as illustrated, the leading end of each filled holder 13 is slid or tucked under a hold-down ledge which is provided as an integral part of the end closure, as described hereinafter.

The bottom closure flap 27 hinged to the bottom panel 19 includes an intermediate line of weakness 65 which divides it into a main panel 67 having a height equal to that of the holders 13 and a flange 69 which is adapted to be bent over the adjacent ends of the eight potted-plant holders and thus to constitute the lower half of the hold-down ledge shown in FIG. 1. In addition, the bottom flap 27 is die-cut to provide a pair of elongated openings 71 which are straight at the top and have curved lower ends.

Figure 5:
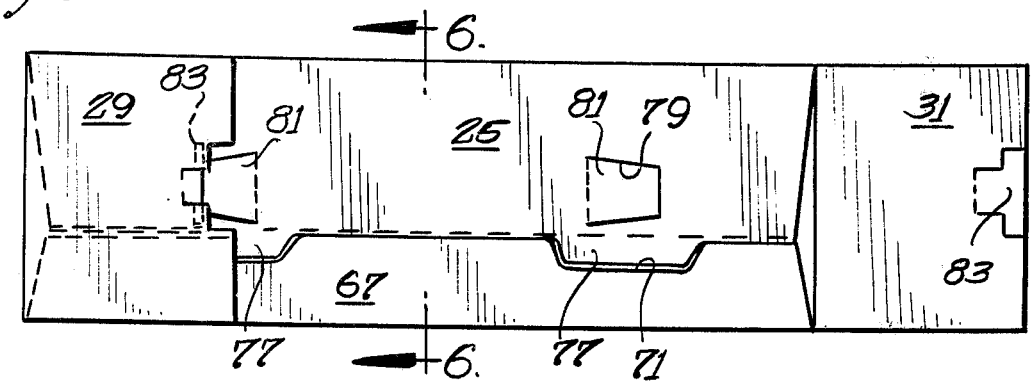
FIG. 5 is an end view of the nearly completed package with the right-hand side flap yet to be closed.

The top closure flap 25 also has a line of weakness 73 that defines a flange 75 which backs up and reinforces the lower flap flange 69 and thus completes the hold-down ledge. However, the line of weakness 73 is interrupted at two points where the flap 25 is die-cut to create a pair of depending lugs 77 which, as best seen in FIG. 5, are received in the openings 71 that are die-cut from the lower flap 27. The presence of the holders 13 prevents the lower flap 27 from being displaced into the tubular enclosure, and the abutment of the lugs 77 against the flat upper edge of the openings 71 prevents the upper flap 25 from being displaced into the enclosure, thus assuring that the pair of flanges 69,75 which together constitute the hold-down ledge are maintained in the precise operative alignment desired.

Figure 6:
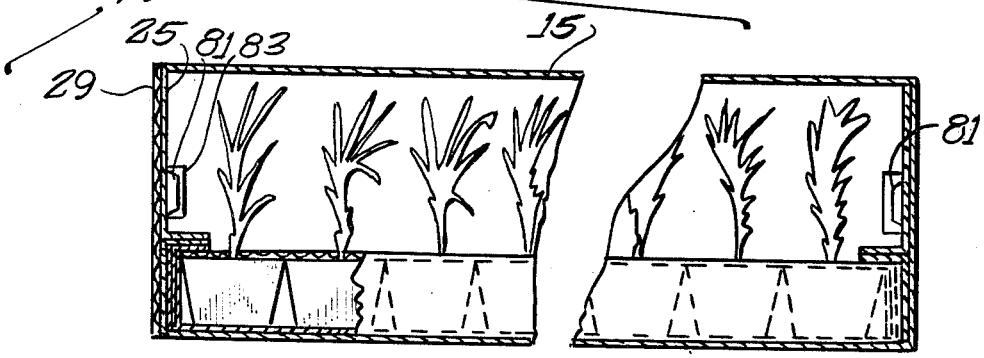
FIG. 6 is a sectional view taken along the line 6—6 of FIG. 5.

In addition, a pair of apertures 79 are cut in the main portion of the top flap 25 at locations generally above the lugs 77. The apertures 79 are only die-cut on three sides so that the flap material remains to serve as a hinged keeper 81. Each of the side flaps 29,31 that are hinged respectively to the side panels 17 and 21 are die-cut with a T-shaped tab 83 at the end edge thereof. As shown in FIGS. 5 and 6, after the side flap 29 is folded into abutting contact with the vertical surfaces of the top and bottom flaps, it is locked in this position by pushing the T-shaped tab 83 through the aperture 79 which is of a slightly lesser vertical dimension, and the presence of the keeper 81 pressing against the tab as a result of the natural resiliency of the corrugated fiberboard assures that accidental unlocking will not occur. The remaining right-hand flap 31 is folded and locked in a similar manner.

The overall package which is created is relatively simple to assemble and requires no stapling, gluing or taping. The individual holders 13 each securely package and cushion a row of potted plants, and once filled, they can be handled independently of the outer case 11 without any particular restraints. Thus, if it is desired to ship a mixture of different plants, certain potted varieties can be filled into holders at spaced-apart locations, and the holders can be then transported on conveyors or the like to a central packaging location.

The design of the outer container end closure provides a pair of abutting flanges 69,75 which are in surface-to-surface contact with each other and which resiliently bear against each other as a result of the natural resiliency of corrugated fiberboard amplified by the fact that the score lines 65,73 which define the flanges run perpendicular to the flutes of the corrugated board. Moreover, the two-flange hold-down ledge is locked in precise operative condition against the upper surfaces of the potted plant holders by means of the lugs 77 which nest in the proportioned openings 71 of the lower flap and are secured in this position by the locking of the side flaps 29,31 in surface-to-surface contact with the vertical portions of both of the upper and lower flaps by means of the T-shaped tabs 83 and the keepers 81. Thus, a relatively simple outer container is provided which can be folded and set up quickly with no gluing, taping or stapling because the locking is effected by simply pressing two T-shaped tabs through aligned openings at each end of the package.

Although the invention has been illustrated and described with respect to a particular preferred embodiment, it should be understood that various changes and modifications as would be obvious to one having the ordinary skill in the art may be made without deviating from the scope of the invention which is defined solely by the appended claims. Although the term "score line" is used to refer to a line about which bending of the blank occurs, it should be understood that the term is used in its broadest sense to indicate a line of weakness which can be made by scoring, perforating, scarifying, creasing or in any equivalent manner. Various of the features of the invention are set forth in the claims which follow.

What is claimed is:

1. A package for shipping potted plants which comprises an outer fiberboard container and a plurality of elongated plant holders which are received within said outer container, each of said holders comprising an integral fiberboard blank which is provided with four parallel, longitudinal lines of weakness of which define a bottom wall, a pair of side walls, and two partial cover panels hinged respectively to the upper edges of said side walls and which includes locking flap means at both ends thereof for closing the respective ends and thereby securing said holder in tubular form with said partial cover panels overlying the edges of potted plants disposed therewithin but leaving a central opening through which the stems of the potted plants protrude upward, said outer container comprising top, bottom and a pair of side panels disposed at right angles to one another to form a shipping enclosure and end closure flaps hinged to opposite ends of each of said panels, said flaps attached to said bottom panel including a main portion equal in length to about the height of said holders and terminating in a first flange which extends for substantially the width of said container and overlies the ends of said plurality of holders, said flaps attached to said top panels including a main portion having a second flange hinged to the lower end thereof which flange lies in overlying surface contact with said first flange, and also including depending lug means formed from the region of said second flange which lug means extend below the upper edge of said holders and prevent the displacement of said top flap into said enclosure, said flaps attached to said side panels including means for interlocking with at least one of said top and bottom flaps to complete the end closure, whereby a plurality of said potted plant-carrying holders arranged in abutting side-by-side relationship on said bottom panel are secured against said bottom panel by the presence of said overlying first and second flanges at each end thereof.

2. A package in accordance with claim 1 wherein opening means is provided in the vertical portion of said bottom flap which is proportioned to accommodate said lug means.

3. A package in accordance with claim 1 wherein tab means is provided in said side flaps and cooperating aperture means for receiving said tab means are provided in the vertical portion of said top flap.

4. A package in accordance with claim 1 wherein one of said partial cover panels of said holders is proportioned to overlie said other partial cover panel at the end of said holder.

5. A package in accordance with claim 4 wherein said overlying cover panel has an end flap hinged thereto that includes tab means for interlocking with a flap hinged to one of the walls of said holder.

6. A package for shipping potted plants which comprises an outer fiberboard container and a plurality of elongated plant holders which are arranged in abutting side-by-side relationship within said outer container, each of said holders comprising an integral fiberboard blank which is foldable generally along four parallel, longitudinal lines to provide a bottom wall, a pair of side walls, and a pair of partial cover panels hinged respectively to the upper edges of said side walls and a row of potted plants being disposed on said bottom wall, with said partial cover panels overlying edges of said potted plants but leaving central opening means through which the stems protrude, said outer container comprising top, bottom and a pair of side panels disposed at right angles to one another to form a shipping enclosure and end closure flaps hinged to opposite ends of each of said panels, said flaps attached to said bottom panel including a main portion equal in length to about the height of said holders and terminating in a first flange which extends for substantially the width of said container and overlies the ends of said plurality of holders, said flaps attached to said top panels including a main portion having a second flange hinged to the lower end thereof which flange lies in overlying surface contact with said first flange and lug means cut from the region of said second flange which lug means depend to a point below the upper surface of said holders and said flaps attached to said side panels including means for interlocking with at least one of said top and bottom flaps to complete the end closure, whereby said plurality of potted-plant-carrying holders are secured against said bottom panel by the presence of said overlying first and second flanges at each end thereof.

7. A package in accordance with claim 6 wherein said interlocking means includes a T-shaped tab formed in the upper portion of each flap which is received in aperture means provided in said main portion of said top flaps.

8. A package for shipping potted plants which comprises an outer fiberboard container and a plurality of elongated plant holders which are received within said outer container, each of said holders comprising an intergral fiberboard blank which is provided with four parallel, longitudinal lines of weakness which define a bottom wall, a pair of side walls, and two partial cover panels hinged respectively to the upper edges of said side walls, one of said partial cover panels being proportioned to overlie the other partial cover panel at both end regions of said holders, said blank also including flap means at both ends thereof for closing the respective ends, which includes a flap hinged to said overlying cover panel and another flap hinged to one of said walls, said overlying cover panel flap including tab means for interlocking with said other end flap to secure said holder in tubular form with said partial cover panels overlying the edges of potted plants disposed therewithin but leaving a central opening through which the stems of the potted plants protrude upward, said outer container comprising top, bottom and a pair of side panels disposed at right angles to one another to form a shipping enclosure and end closure flaps hinged to opposite ends of each of said panels, said flaps attached to said bottom panel including a main portion equal in length to about the height of said holders and terminating in a first flange which extends for substantially the width of said container and overlies said overlying cover panels at the ends of said plurality of holders, said flaps attached to said top panels including a main portion having a second flange hinged to the lower end thereof which flange lies in overlying surface contact with said first flange, and said flaps attached to said side panels including means for interlocking with at least one of said top and bottom flaps to complete the end closure, whereby a plurality of said potted plant-carrying holders arranged in abutting side-by-side relationship on said bottom panel are secured against said bottom panel by the presence of said overlying first and second flanges at each end thereof.

9. A package in accordance with claim 8 wherein said holder includes a generally T-shaped flap hinged to said bottom wall and the side wall to which said other partial cover is hinged includes a further hinged end flap having an opening proportioned to accommodate said tab means.

10. A package in accordance with claim 9 wherein said further hinged end flap includes a tab for interengagement with said T-shaped flap.

* * * * *